US007008739B1

(12) United States Patent
Kang et al.

(10) Patent No.: US 7,008,739 B1
(45) Date of Patent: Mar. 7, 2006

(54) PROCESS FOR MANUFACTURING FLUORESCENT FILM OF A COLOR BRAUN TUBE

(75) Inventors: Seoug Wan Kang, Kumi-si (KR); Kyung Ho Lee, Kumi-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 08/633,212

(22) Filed: Apr. 16, 1996

(30) Foreign Application Priority Data

Apr. 17, 1995 (KR) ..... 95-8973

(51) Int. Cl.
*H01J 9/227* (2006.01)

(52) U.S. Cl. ..... 430/26; 430/23; 430/25; 427/68; 427/71; 427/72; 427/73

(58) Field of Classification Search ..... 427/68, 427/71–73; 430/25, 26, 23
See application file for complete search history.

(56) References Cited

U.S. PATENT DOCUMENTS 3,146,368 A * 8/1964 Fiore et al. ..... 430/25
3,697,301 A * 10/1972 Donofrio et al. ..... 428/340
4,052,519 A * 10/1977 Prazak, III ..... 427/68
4,572,880 A * 2/1986 Miura ..... 430/23
4,770,962 A * 9/1988 Brennesholtz ..... 430/25
4,859,549 A * 8/1989 Hayashi ..... 430/25
5,213,918 A * 5/1993 Donofrio ..... 430/23

FOREIGN PATENT DOCUMENTS

JP 56-112051 * 9/1981

OTHER PUBLICATIONS

Translation of JP 56-112051 Sep. 1981.*

* cited by examiner

*Primary Examiner*—Martin Angebranndt
(74) *Attorney, Agent, or Firm*—Birch, Stewart, Kolasch & Birch, LLP

(57) ABSTRACT

The present invention is to provide a process for manufacturing a fluorescent film wherein the order of coating the fluorescent films of a color Braun tube and the thickness of the film are adjusted to reduce the amount of red fluorescent material employed for red fluorescent film without deteriorating the quality of the red fluorescent film, thereby lowering the cost for manufacturing. The process first forms the red fluorescent film on the panel of a color Braun tube and then forms the blue and green fluorescent films subsequently thereafter.

16 Claims, 3 Drawing Sheets

PROCESS FOR MANUFACTURING FLUORESCENT FILM OF A COLOR BRAUN TUBE

FIELD OF THE INVENTION

The present invention relates to a process for manufacturing a fluorescent film of a color Braun tube. More specifically, the present invention relates to a process for manufacturing a fluorescent film of a color Braun tube having a red fluorescent film that is first applied and its thickness adjusted to enhance quality increase brightness and reduce the amount of red fluorescent material used for the red fluorescent film employed.

BACKGROUND OF THE INVENTION

Three-color fluorescent materials, e.g., red phosphor, blue phosphor and green phosphor, are used in a color Braun tube, a fluorescent lamp, a projection type cathode-ray tube, or the like. A color Braun tube generally comprises as its essential component a fluorescent screen coated with three-color (green G, blue B, red R) fluorescent materials which radiate by an electronic ray on an inner surface of the screen.

The process for manufacturing such a fluorescent screen is largely divided into a coating of light-absorbing black material (BM) [FIG. 1] and a coating of three-color fluorescent materials such as green phosphor, blue phosphor, and red phosphor (PH) [FIG. 2].

As illustrated in FIG. 1, the BM coating process comprises washing and drying panel (1) and then injecting and coating a photoresist thereto to form photoresist film; patterning the photoresist films to define a part to form a fluorescent film of three primary colors (R, G, B); forming a film of graphite coated on the panel (1) including the patterned photoresist film; etching the graphite coating using the patterned photoresist film as a mask; and then developing and drying thereof to form a graphite matrix (2).

Subsequently, as illustrated in FIG. 2, the inner surface of the face plate passed through the BM process as above is washed with warm, pure water and coated with a precoat, and then coated with a mixed liquid of green (or blue) fluorescent material and photoresist resin and then dried to form a green fluorescent [or blue fluorescent] material layer.

Subsequently, ultra-violet (UV) rays irradiate the green fluorescent layer [or blue fluorescent material layer] through the hole of a shadow mask.

At this time, the position of UV irradiation corresponds to the position of electron beam collision for radiating the green (or blue) fluorescent material layer, or to the position for the green (or blue) fluorescent material layer to be fixed.

Then, upon washing the panel (1) irradiated by UV with a solvent, a part cured by UV irradiation remains undissolved on the face plate surface, while the other part is dissolved and removed to form a green fluorescent film (4) [or blue fluorescent film (3)], as illustrated in FIG. 4.

Second, similar procedures are carried out as to the first process above using a mixture layer of blue fluorescent material [or green fluorescent material] and a photosensitive resin to form a blue fluorescent film (3) [or green fluorescent film (4)]. Third, similar procedures are carried out as to the first process above using a mixture of red fluorescent material and a photosensitive resin to form a red fluorescent film (5) as illustrated in FIG. 3.

After the coating the three-color fluorescent films (3), (4) and (5), an emulsion is coated in order to even an Al-deposited film to that completes the PH process.

As described above, according to the conventional process for PH coating, the red fluorescent film (5) is finally formed when the three-color fluorescent are coated on the inner surface of the face plate, having the following order of formation: green→blue→red fluorescent film or blue→green→red fluorescent film. In this case, however, upon the formation of green→blue (or blue→green) fluorescent film, flection occurs creating an uneven surface on which to form the red fluorescent film (5) on the inner surface of the panel glass (1). Thus, the distribution of the red fluorescent film (5) finally coated is not homogeneous, whereby inferiorities such as cracks, light leakage, or the like readily occur. Further, owing to the uneven thickness, white brightness, bright uniformity and white uniformity deteriorate, so that the thickness of the red fluorescent film (5) formed is thicker by about 30% than that of the green or blue fluorescent films (4) and (5), as shown in FIG. 3. The increase of the amount of the red fluorescent material used to make the red fluorescent film (5) increases the prime cost (i.e., red fluorescent material has an about a 10-fold price than that of green or blue fluorescent material).

More specifically, calculated values of optimum S/Weight (i.e., coating weight per unit area) of the fluorescent material are as follows:

A. Green fluorescent material for the greed fluorescent film (particle size: 11.5 $\mu$m, apparent density: 1.62 g/cm$^3$)
   1) Optimum thickness of the green fluorescent film: about 1.5-fold of the particle size of the phosphor, i.e., 11.5×1.5=17.25 $\mu$m
   2) Optimum S/Weight screen weight (i.e., S/Weight): 1.62 g/cm$^3$×0.001725 cm×1000 mg/g=2.8 mg/cm$^2$ (i.e., the weight of green fluorescent material per unit area)

B. Blue fluorescent material for the blue fluorescent film (particle size: 11.5 $\mu$m, apparent density: 1.16 g/cm$^3$)
   1) Optimum thickness of the blue fluorescent film: about 1.5-fold of the particle size of the phosphor, i.e., 11.5×1.5=17.25 $\mu$m
   2) Optimum S/Weight: 1.16 g/cm$^3$×0.001725 cm×1000 mg/g=2.0 mg/cm$^2$ (i.e., the weight of blue fluorescent material per unit area)

C. Red phosphor (particle size: 11.5 $\mu$m, apparent density: 1.66 g/cm$^3$)
   1) Optimum thickness of the red fluorescent film: about 1.5-fold of the particle size of the phosphor, i.e., 11.5×1.5=17.25 $\mu$m
   2) Optimum S/Weight: 1.66 g/cm$^3$×0.001725 cm×1000 mg/g=2.9 mg/cm$^2$ (i.e., the weight of red fluorescent material per unit area)

As can be seen form the calculated optimum S/Weight as above, the S/Weight ratio of green phosphor to red phosphor is optimum at 1.00:1.04, but the ratio of 1.00:1.30–1.50 is practically used.

SUMMARY OF THE INVENTION

The present invention was invented in order to solve the problems of the prior art mentioned above, and the object of the invention is to provide a process for manufacturing a fluorescent film for color Braun tube in which a red fluorescent film is first formed and its thickness thereof reduced to enhance the quality of the red fluorescent film and to lower the cost for manufacturing.

To achieve the above object, the present invention provides a process for manufacturing a fluorescent film which comprises a stage of forming BM (Black Matrix) wherein a matrix of light-absorbing material is formed on a panel in order to define a portion on which the fluorescent film of three primary colors (R, G, B); a stage of forming a red fluorescent film wherein a mixed slurry of a red fluorescent material and a photosensitive resin is coated on the panel including the matrix of light-absorbing material, dried, and cured by irradiating UV ray through the hole of shadow mask onto a portion on which the red fluorescent film is to be formed, and then washed with a solvent; a stage of forming a blue or green fluorescent film wherein a mixed slurry of a blue or green fluorescent material and a photosensitive resin is coated on the panel on which the red fluorescent film has been formed, dried, and cured by irradiating UV ray through the hole of shadow mask onto a portion on which the blue or green fluorescent film is to be formed, and then washed with a solvent; and a stage of forming a remaining blue or green fluorescent film wherein a mixed slurry of a remaining blue or green fluorescent material and a photosensitive resin is coated on the panel on which the said fluorescent films have been formed, dried, and cured by irradiating UV ray through the hole of shadow mask onto a portion on which the remaining blue or green fluorescent film is to be formed, and then washed with a solvent.

DETAILED DESCRIPTION OF THE PREFERRED EMBODIMENT

Figure 1:
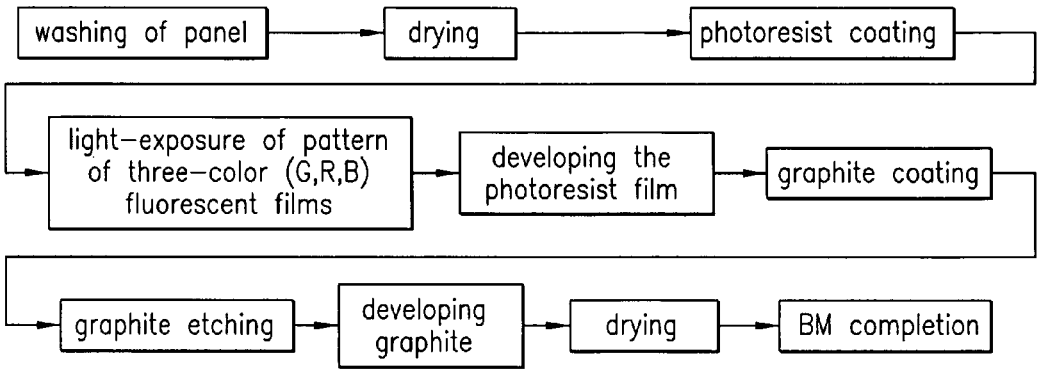
FIG.1 prior art
FIG. 1 is a flow chart of a conventional process for graphite coating.
Figure 2:
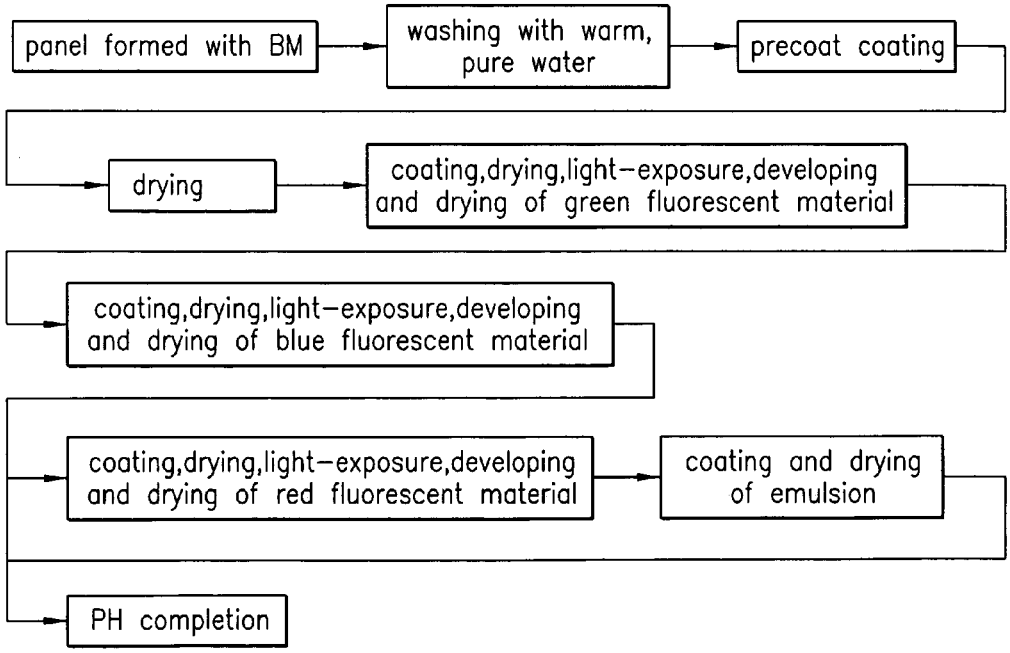
FIG.2 prior art
FIG. 2 is a flow chart of a conventional process for fluorescent material coating.
Figure 3:
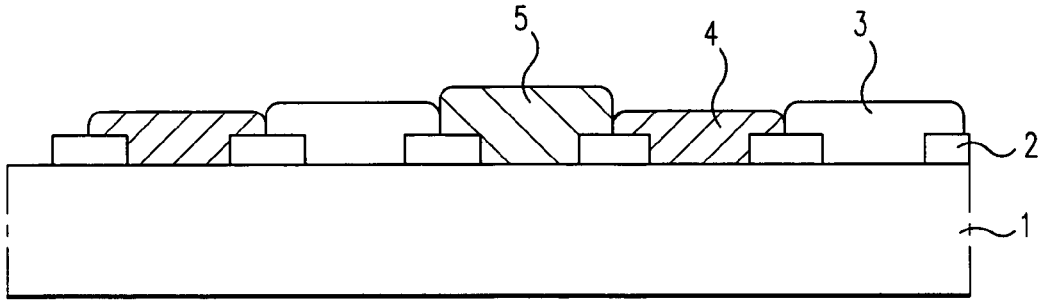
FIG.3 prior art
FIG. 3 is a sectional view of a conventional fluorescent material coating.
Figure 4:
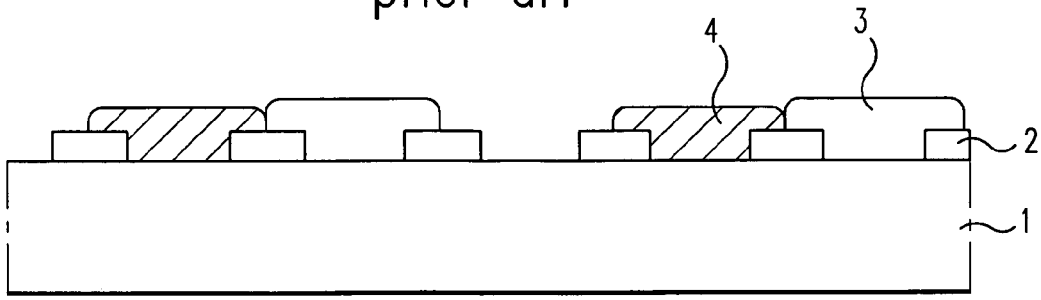
FIG.4 prior art
FIG. 4 is a sectional view of a conventional fluorescent screen after the coating of green and blue films.
Figure 5A:
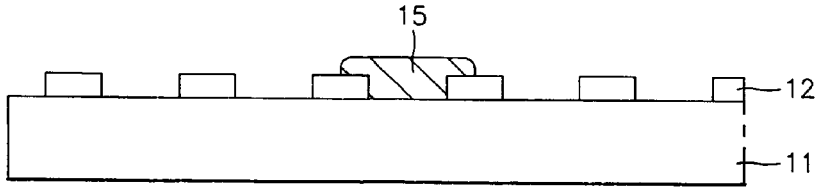
FIGS. 5(A), 5(B) and 5(C) are sectional views showing the coated state of the fluorescent films formed according to an embodiment of the present invention.

First, as illustrated in FIG. 5(A), a black matrix (12) of light-absorbing material (such as graphite) is formed on a panel (11) to define a portion to which fluorescent films of three primary colors (R, G, B) are to be laminated, according to the same process as the conventional technique.

Then, a mixed slurry of a red fluorescent material and a photosensitive resin is coated on the panel (11) including the matrix of light-absorbing material, dried, and cured by irradiating UV ray through the hole of shadow mask onto a portion on which the red fluorescent film is to be formed, and then the panel is soaked in a solvent to form a red fluorescent film (15).

Figure 5B:
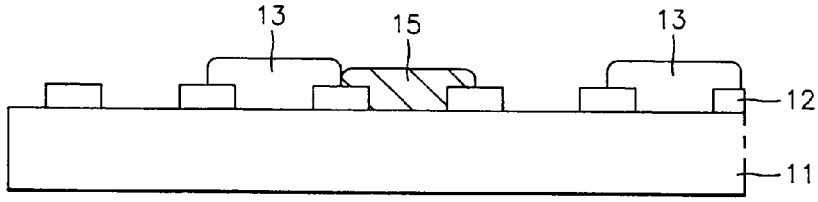

Subsequently, as illustrated in FIG. 5(B), after a slurry of a blue fluorescent material and a photosensitive resin is coated and dried, a blue fluorescent film (13) is formed according to the same process of formation of the red fluorescent film.

Figure 5C:
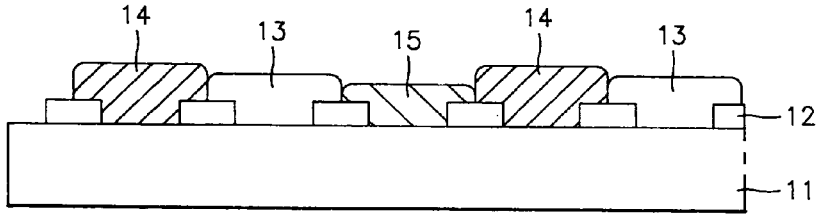

Subsequently, as illustrated in FIG. 5(C), after a slurry of a green fluorescent material and a photosensitive resin is coated and dried, a green fluorescent film (14) is formed according to the same process of formation of the blue fluorescent film (13) or the red fluorescent film (15).

An emulsion film is then formed and it is Al-deposited.

In the above embodiment, the order of the value of S/Weight of the three color phosphor is that the green fluorescent material>red fluorescent material>blue fluorescent material, and preferably the S/Weight ratio of these phosphor is red phosphor:blue phosphor:green phosphor=1.0:0.7–0.9:1.0–1.2.

If the S/Weight of the blue and green phosphor are more than 0.9 and more than 1.2, respectively, with reference to the red phosphor of S/Weight 1.0, the fluorescent film may be separated during the process of the fluorescencer coating, to disturb the formation of the fluorescent film. In contrast, if the S/Weight of the blue and green phosphor are less than 0.7 and less than 1.0, respectively, with reference to the red phosphor of S/Weight 1.0, a fluorescent film of good quality cannot be obtained owing to the inferiority of light-leakage, roughness of the film, or the like.

The finally formed green fluorescent film having green fluorescent material to which pigment has not been adherent, while the red and blue fluorescent films having red and blue fluorescent materials, respectively, ones are preferably the fluorescent films to which pigment has been adhered respective to their fluorescent materials.

If a pigment is adhered to a fluorescent material, the dispersibility is deteriorated because the fluorescent material particles are not smooth. Thus, pigment is not adhered to the finally coated fluorescent material so that the dispersibility and adhesive strength may be improved to obtain a fluorescent film of excellent white brightness, white uniformity and bright uniformity.

Figure 6A:
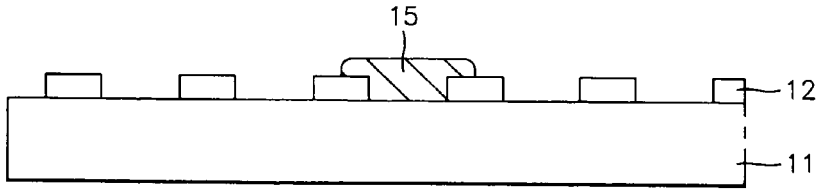
FIGS. 6(A), 6(B) and 6(C) are sectional views showing the state of the fluorescent films according to a further embodiment of the present invention.
Figure 6B:
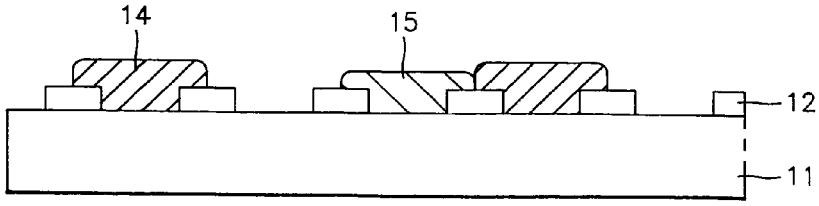
Figure 6C:
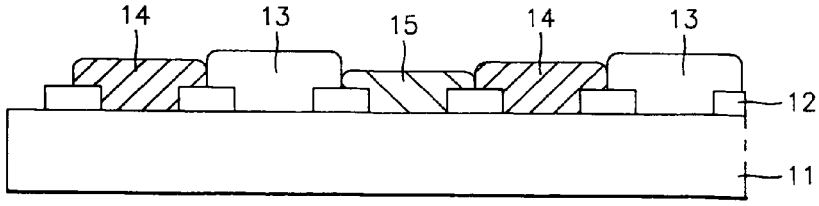

FIGS. 6(A) to 6(C) illustrate further embodiments of the present invention. In these embodiments, after the formation of the red fluorescent film, a green fluorescent film (14) is formed before a blue fluorescent film (13) is formed, while a blue one (13) is formed before a green one (14) is formed in the previous embodiment. As other procedures are the same as the previous embodiment, detailed description is omitted.

Comparisons between the color Braun tube (20") manufactured according to the conventional process and that of the present invention are shown in Table 1 below:

| | Conventional process | | The present invention |
|---|---|---|---|
| Order of coating | G → B → R | | R → B → G |
| S/Weight (mg/cm$^2$) | G | 3.0 | 3.3 |
| | B | 3.0 | 2.8 |
| | R | 3.8 | 3.0 |
| White brightness | 100% | | 103% |
| No. of Defects per unit area | 5 | | 2 |

As can be shown in Table 1, according to the process of the present invention, the required amount of red phosphor is reduced by 15–35%, and the quality such as white brightness, white uniformity and bright uniformity of the coated films is improved as is confirmed by the number of defects per unit area.

Particularly, a pigment to affect contact is not coated to the finally coated fluorescent material, so that the film may have excellent adhesive strength and dispersibility, whereby an excellent fluorescent film of a color Braun tube having almost the same thickness of three color fluorescent films is obtained.

What is claimed is:

1. A method for manufacturing a fluorescent film on a screen for a color braun tube comprising the steps of:

forming a black matrix of a light-absorbing material on the screen, the matrix being formed so as to expose portions of the screen;

forming a red fluorescent film pattern on the screen having the black matrix formed thereon, wherein the screen weight of the red fluorescent film pattern is between 2.47 mg/cm$^2$ and 3.23 mg/cm$^2$;

forming a blue fluorescent film pattern on the screen having the black matrix and the red fluorescent film pattern formed thereon;

forming a green fluorescent film pattern on the screen having the black matrix and red and blue fluorescent film patterns formed thereon;

wherein:

(a weight of the green fluorescent film pattern per unit area)>(a weight of the red fluorescent film pattern per unit area)>(a weight of the blue fluorescent film pattern per unit area).

2. The method according to claim 1, wherein ratio of the weight of each of the film patterns per unit area for the red, blue, and green fluorescent film patterns, respectively, is 1.0:0.7–0.9:1.0–1.2.

3. The method according to claim 1, wherein the red, blue, and green fluorescent film patterns are made from red, blue, and green phosphor, respectively.

4. The method according to claim 3, wherein said red and blue phosphors have a pigment adhered thereto, while the green phosphor does not have a pigment adhered thereto.

5. The method according to claim 1, comprising a step of forming an emulsion layer on the screen having the black matrix and red, blue, and green fluorescent film patterns formed thereon.

6. The method according to claim 1, wherein said step of forming the black matrix comprises the steps of:

forming a photoresist pattern array on the screen;

forming a light-absorbing material layer on the screen having the photoresist pattern formed thereon; and removing overlying portions of the light-absorbing material layer by lifting off the photoresist pattern array to obtain the black matrix.

7. The method of claim 6, wherein the light-absorbing material is graphite.

8. The method according to claim 1, wherein said step of forming a fluorescent film pattern comprises:

coating a slurry of one of a red, blue, and green phosphor, respectively, and a photosensitive resin on the screen to form a phosphor layer on the screen;

drying the phosphor layer;

selectively curing portions of the phosphor layer by irradiating an ultraviolet light on the phosphor layer through a shadow mask; and washing away uncured portions of the phosphor layer to obtain the fluorescent film pattern.

9. A method for manufacturing a fluorescent film on a screen for a color braun tube, comprising the steps of:

forming a black matrix of a light-absorbing material on the screen, the matrix being formed so as to expose portions of the screen;

forming a red fluorescent film pattern on the screen having the black matrix formed thereon, wherein the screen weight of the red fluorescent film pattern is between 2.47 mg/cm$^2$ and 3.23 mg/cm$^2$;

forming a green fluorescent film pattern on the screen having the black matrix and the red fluorescent film pattern formed thereon;

forming a blue fluorescent film pattern on the screen having the black matrix and red and green fluorescent film patterns formed thereon;

wherein:

(a weight of the green fluorescent film pattern per unit area)>(a weight of the red fluorescent film pattern per unit area)>(a weight of the blue fluorescent film pattern per unit area).

10. The method according to claim 9, wherein ratio of the weight of each of the film patterns per unit area for the red, blue, and green fluorescent film patterns, respectively, is 1.0:0.7–0.9:1.0–1.2.

11. The method according to claim 9, wherein the red, blue, and green fluorescent film patterns are made from red, blue, and green phosphor, respectively.

12. The method according to claim 11, wherein the red and green phosphors have a pigment adhered thereto, while the blue phosphor does not have a pigment adhered thereto.

13. The method according to claim 9, comprising a step of forming an emulsion layer on the screen having the black matrix and red, blue, and green fluorescent film patterns formed thereon.

14. The method according to claim 9, wherein said step of forming the black matrix comprises the steps of:

forming a photoresist pattern array on the screen;

forming a light-absorbing material layer on the screen having the photoresist pattern formed thereon; and removing overlying portions of the light-absorbing material layer by lifting off the photoresist pattern array in order to obtain the black matrix.

15. The method of claim 14, wherein the light-absorbing material is graphite.

16. The method according to claim 9, wherein said step of forming a fluorescent film pattern comprises: coating a slurry of one of a red, green, and blue phosphor and a photosensitive resin on the screen to form a phosphor layer on the screen;

drying the phosphor layer;

selectively curing portions of the phosphor layer by irradiating an ultraviolet light on the phosphor layer through a shadow mask; and washing away uncured portions of the phosphor layer to obtain one of a red, green, and blue fluorescent film pattern.

* * * * *